United States Patent [19]

Kirk, Jr.

[11] 4,434,915

[45] Mar. 6, 1984

[54] CHILD-RESISTANT FINGER PUMP DISPENSER

[75] Inventor: Donald C. Kirk, Jr., Midlothian, Va.

[73] Assignee: Ethyl Products Company, Richmond, Va.

[21] Appl. No.: 334,340

[22] Filed: Dec. 24, 1981

[51] Int. Cl.[3] ..... B65D 83/41

[52] U.S. Cl. ..... 222/153; 222/321; 222/383

[58] Field of Search ..... 222/153, 321, 41, 43, 222/47, 383; 215/222, 341, 347, 348, 217

[56] References Cited

U.S. PATENT DOCUMENTS

| | | | |
|---|---|---|---|
| D. 244,991 | 7/1977 | Weckman et al. | 222/383 X |
| 3,306,497 | 2/1967 | Kenney et al. | 222/182 |
| 3,339,770 | 9/1967 | Weigand | 215/222 X |
| 4,057,159 | 11/1977 | Fillmore et al. | 215/347 X |
| 4,065,036 | 12/1977 | Kirk | 222/153 |
| 4,071,173 | 1/1978 | Horan | 222/321 |
| 4,159,067 | 6/1979 | Akers | 222/153 |
| 4,189,064 | 2/1980 | O'Neill et al. | 222/321 |

FOREIGN PATENT DOCUMENTS

| | | | |
|---|---|---|---|
| 52-48115 | 4/1977 | Japan | 222/321 |

*Primary Examiner*—Joseph J. Rolla
*Assistant Examiner*—Kevin P. Shaver
*Attorney, Agent, or Firm*—Donald L. Johnson; John F. Sieberth; E. Donald Mays

[57] ABSTRACT

A child resistant finger pump dispenser having a vertically oriented body member or tank. The tank has a piston therein with an attached hollow outlet stem extending out of its upper end. An actuator button is attached to the upper end of the stem and has a laterally directed spray nozzle extending from the side of the skirt portion of the actuator. A housing has an upper portion that partially surrounds the actuator button and a lower portion that supports the tank and includes a depending skirt having a multiplicity of short threads with projections adjacent their ends on the inner wall of the downwardly depending skirt. The container neck is provided on its outside surface with a multiplicity of interrupted threads, some having recessed portions on their underside adjacent their terminal ends to receive the projections on the threads on the closure member skirt portion. The upper portion of the housing has opposed flat portions on its inner sidewall which cooperates with opposed flat surfaces on the actuator to prevent rotation of the spray nozzle. The short threads on the lower skirt portion are so positioned that when the housing is attached to an oval or non-cylindrical container having the interrupted threads with the projections on their ends that the short threads of the closure will engage the undercuts on the long threads of the container so that the spray nozzle of the pump is parallel to the major transverse axis of the container to provide fixed orientation of the pump with respect to the container.

2 Claims, 6 Drawing Figures

CHILD-RESISTANT FINGER PUMP DISPENSER

BACKGROUND OF THE INVENTION

1. Field of the Invention

This invention relates to a dispensing assembly including a finger actuated vertically disposed pump attached to a noncylindrical container with the spray nozzle of the pump oriented in the same direction as the major transverse axis of the container.

2. Description of the Prior Art

Finger actuated, hand-held, vertically oriented reciprocating pumps have found increasing use in recent years for dispensing numerous products either in the form of a fine spray or a stream from hand-held dispensing containers. A large number of various types of commercial finger actuated reciprocating pumps are used in dispensing products from packages of personal use items such as colognes, lotions, skin conditioners, and of household items, such as glass cleaners, insecticides, spot removers, rug cleaners, bathroom cleaners, and many other household commodities. Additionally these finger pumps are used to dispense products used in the automotive market i.e., vinyl roof cleaners, vinyl roof protective coating, rubber conditioners, upholster cleaners, tire cleaners, degreasers, etc.

Generally the commercial finger pumps offered in the present day commercial market are equipped with conventional continuous thread caps which attach the pump to the conventional continuous threaded neck of the container in which the particular product is packaged. In cases where the product is packaged in the cylindrical, "Boston Round" type bottle the free turning actuator buttons with side directed spray nozzles or discharge tubes used on conventional pumps has been adequate since no orientation of the actuator button is needed in connection with the container since it has a uniformed diameter. Cylindrical containers are generally safisfactory for use with vertical finger pumps as long as the container is of a modest size which can be easily gripped by the hand of an adult. However, many products are offered to the consumer market in containers which are generally described as "ovals" which are non-cylindrical i.e., the container has a major and a minor radius resulting from the container having a generally flat front and back surface with narrow sides. This permits larger volume containers to be utilized. In utilizing oval or non-cylindrical containers in connection with vertical finger actuated pumps there has been a problem of orienting the axis of the side directed spray nozzle of the finger pump with the major diametrical or radial axis of the oval or non-cylindrical container so that when the consumer grasps the container the spray nozzle will be directed in the same direction as the major radial axis of the container. Heretofore there has not been any readily satisfactory commercial mode for assuring that the axis of the pump spray nozzle will coincide with the major radial axis of the container. Generally, after the product container is filled, the pump is placed on the container and a mechanical device is used to torque the threaded closure cap on to the threaded neck of the container. Vertically aligned finger pumps generally have free rotating dispenser actuator members so that the side directed spray nozzle or delivery tube as the case may be, will not be oriented in any specific direction unless the user makes a special effort to align the spray nozzle in a particular direction.

Another desirable feature to incorporate into a finger pump dispenser package is the provision of child-resistant closure devices for prevention of the removal of the pump from the container by juveniles. While there are numerous child resistant closures available commercially, one such closure which is receiving increasing commercial acceptance is a safety closure described in U.S. patent application Ser. No. 161,130 filed June 19, 1980, now abandoned in favor of continuation application Ser. No. 312,804 filed Oct. 19, 1981, now U.S. Pat. No. 4,387,817 issued June 6, 1983, which is owned by the assignee of the present application. This closure utilizes a plurality of barbed short lug threads on the cap to engaged recesses on longer interrupted threads provided on the container neck. However, to date such child resistant closures have only been utilized in solid top caps for general utility in the packaging market wherein no other devices are required to be attached to the closure member. The disclosure of the above noted patent application is incorporated herein by reference.

One of the more successful vertically reciprocating finger pumps presently utilized in commercial product dispensers is the finger pump shown in U.S. Pat. No. 3,306,479. This finger pump is attached to the container by a body piece having spiral threads on its skirt portion. A cylindrical cover piece is mounted on the body piece and is freely rotatable thereon. The cover piece surrounds the side directed actuator button having a nozzle that projects through a vertical slot in the cover piece. Thus the nozzle must be oriented away from the user each time the pump is used by rotating the cover piece.

Pumps of the types shown in U.S. Pat. Nos. 4,065,036 and 4,071,173 provide child-resistant features preventing children from operating the actuator button to dispense product from the pump, however the pump is attached to the container with regular threads which makes it possible for a child to unscrew the pump from the container and to imbibe the contents of the container which may be toxic or deleterious to the child's health.

U.S. Pat. No. 4,159,067 discloses a dispensing pump for containers which utilizes a trigger pump that is attached to the container neck by a plurality of latching dogs spaced around the lip of the container which engage a like number of matching lugs provided on the interior of the skirt of the closure member. However, the closure member requires an interior auxiliary wedging skirt to fit a specially designed slopping inner wall of the container neck to be compatible and fit closely therewith. Additionally, the disclosure of this patent does not provide any solution to the problem of orienting the nozzle of the dispensing pump with the major transverse axis of an oval container.

In view of the present state of the art in reciprocating finger pump dispensing devices it can be seen that there is a need to provide a finger pump-container combination to provide for the automatic orientation of the pump discharge nozzle during the assembly of the pump to the container on the product filling line so that the nozzle is parallel with the major axis of the container. Additionally, there is a need to provide a finger pump-container combination wherein the finger pump is attached to the container with a closure means having a child resistant feature which will prevent the removal of the pump from the container by a child and possible injestion of any harmful material in the product container.

SUMMARY OF THE INVENTION

It is an object of the present invention to provide a child resistant reciprocating finger pump dispenser.

It is also an object of the present invention to provide a child resistant reciprocating finger pump dispenser having means to permit orientation of the spray nozzle with the major transverse axis on the container.

It is another object of the present invention to provide a reciprocating finger actuated pump dispenser which has a child resistant attaching means for attaching the pump to the container.

The foregoing objects are achieved in a child resistant finger pump assembly for dispensing fluids from a container having an interrupted thread arrangement on the neck of the container. The pump includes a housing adapted to be received in the neck of the container and has an annular flange at the upper end of the housing. The stem extends out of the upper end of the pump housing and has attached thereto a dispensing actuator member which is provided with a spray nozzle that projects from the side of the actuator. A closure-guide member is provided which has a transverse wall portion to abut the flange, a central opening therein to receive the stem extending outward from the pump and also is provided with a plurality of thread engaging means on its inner wall to engage the threaded neck portion of the container. The closure-guide member has an integrally formed upper guide collar portion which is adapted to receive at least a portion of the lower part of the dispensing actuator member. The dispensing actuator member and the upper guide collar portion are provided with opposed guiding surfaces to prevent rotation of the dispensing actuator member in the upper guide collar. The threaded neck portion and the thread engaging means on the lower skirt portion are so arranged that when they are interlocked the spray nozzle is in a predetermined oriented position with respect to the major transverse axis of the container.

The many advantages of the present invention can be utilized on a great number of commercial reciprocating finger pumps of the type that are presently available in the commercial market other than the pumps described in the aforementioned U.S. Patents.

Other objects and advantages of the present invention will be more readily apparent from a further consideration of the following detailed description of the drawings and the preferred embodiments of the invention.

DESCRIPTION OF THE PREFERRED EMBODIMENTS

Figure 1:
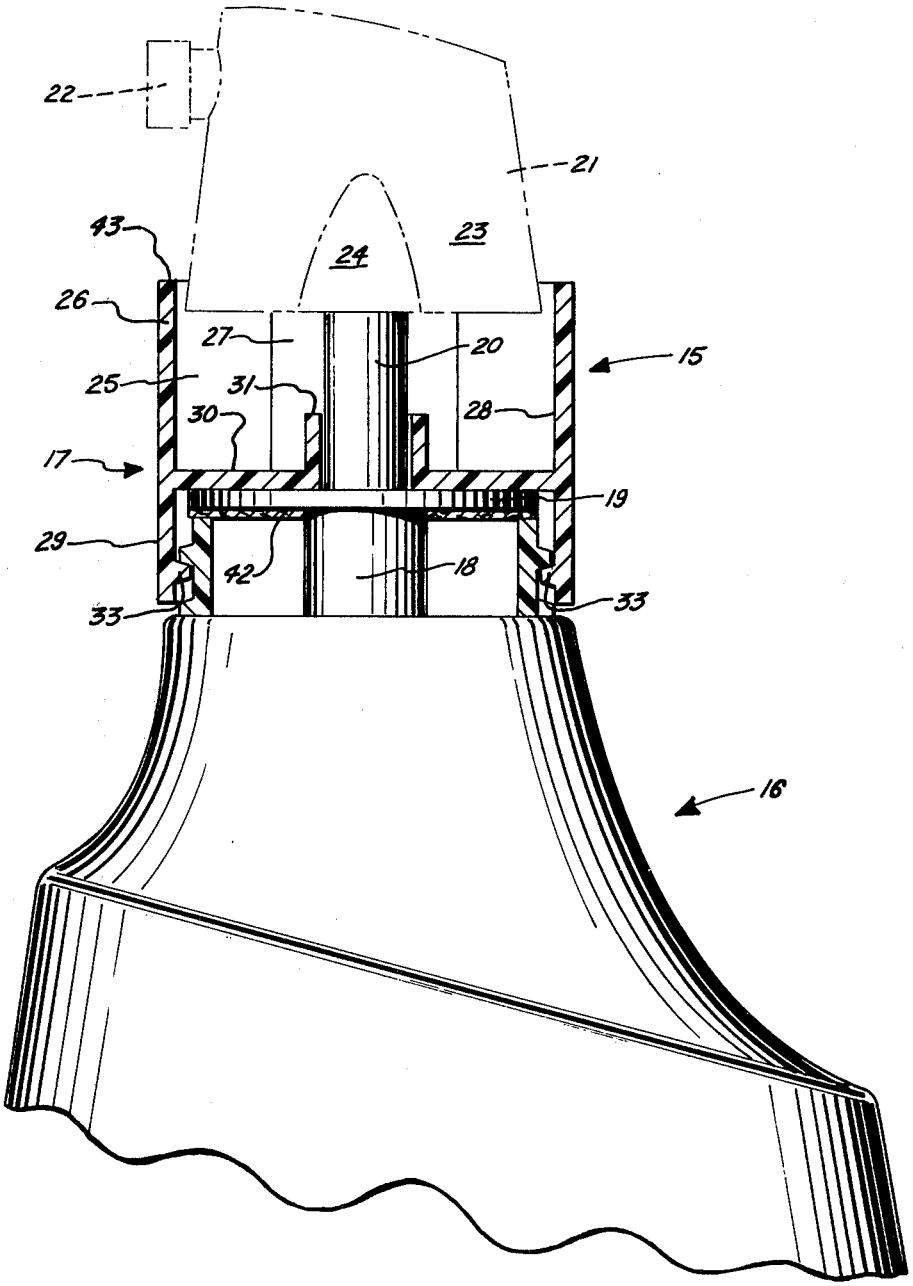
FIG. 1 is a side elevational view of the child resistant finger pump according to the present invention, with portions of the pump and container showing cross sections.

Referring now in particular to FIGS. 1, 4, 5 and 6, an embodiment of the child-resistant finger pump dispenser of the present invention is shown which includes a reciprocating finger pump, designated generally by the numeral 15, which is attached to and retained on the container 16 by means of a closure-guide member 17. The finger pump includes the tank or housing 18 which has a integrally formed annular flange 19 projecting outward from its upper end. The pump has an upwardly extending stem 20 projecting out of an opening (not shown) in the top of the housing 18. The stem 20 has attached at its lower end the conventional piston (not shown) which is biased upwardly by a spring (not shown). The pump is equipped with conventional check valves (not shown). A dip tube (not shown) extends from the lower portion of the tank to convey contents of the container 16 to the pump 15. The upper end of the stem has press fitted thereon a dispensing actuating member 21. The stem 20 and actuating member 21 are both provided with appropriate fluid passages (not shown) which convey liquid from the pump housing to the spray nozzle 22. The side wall skirt 23 of the actuator member 21 can be cylindrical or it may be truncated conical shaped as shown. The side wall of the skirt 23 is provided with two opposed flat guide surfaces 24 (only one of which is seen in FIG. 1). As can be seen in FIG. 1, the lower end of the actuator skirt 23 entends below the top edge 43 of the generally cylindrical upper guide section 26 of the closure-guide member 17 into the open space 25.

Figure 2:
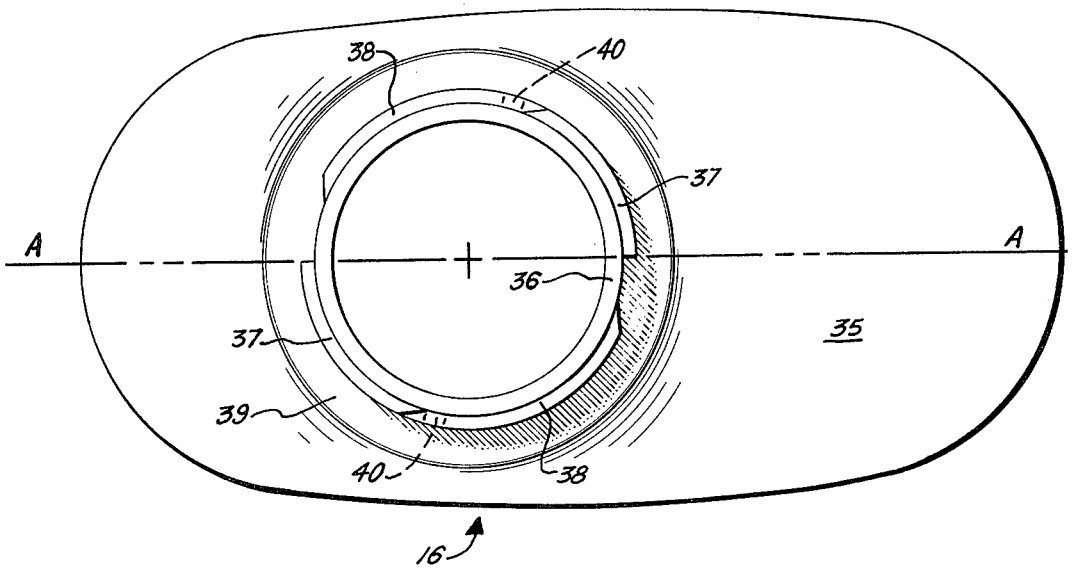
FIG. 2 is a top view of a container adapted for use with the present finger pump dispenser.

Referring now to FIGS. 1, 4, 5 and 6 the closure-guide member 17 is preferably formed by injection molding suitable thermoplastic material so that it provides a generally cylindrical upper guide section 26 that is provided with vertically extending opposed flat sections 27—27 on its interior wall 28. As pointed out hereinbefore these opposed flat wall sections 27—27 cooperate with the opposed flat exterior wall sections 24—24 on the dispensing actuating member 21 to orient and prevent rotation of the actuator member within the closure-guide member 17. The closure-guide member 17 is provided with a lower closure section 29 which is separated from the upper guide section 26 by means of a transverse interior wall 30. The wall has a central opening 43 therein which is surrounded by an upstanding guide collar 31. The guide collar loosely receives and slidingly contacts the stem 20 to permit easy reciprocation of the stem upon pressing and releasing the actuator button 21. Seen in FIGS. 1, 5 and 6 the lower closure section 29 has provided on its inner wall 32 four harpoon-shaped thread members 33 which are adapted to engage the thread members provided on the neck of the container as will be described hereinafter. These harpoon-shaped thread members are positioned on the lower closure section 29 so that they will engage thread member 37 and 38 to orient the closure-guide member 17 and the spray nozzle 21 so that the spray nozzle will be parallel to the major axis A—A, as seen in FIG. 2, of the non-oval container 16. If desired the harpoon-shaped threads 33 may be more or less than the four shown in the drawing.

Figure 3:
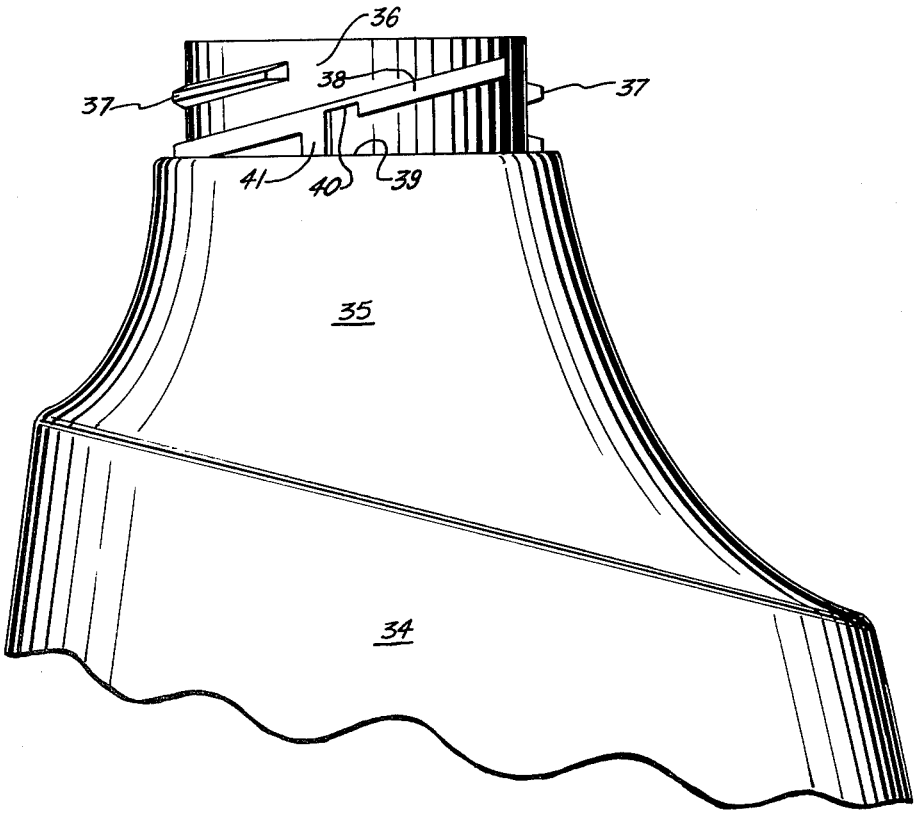
FIG. 3 is a left-hand elevational view of the container of FIG. 2.
Figure 4:
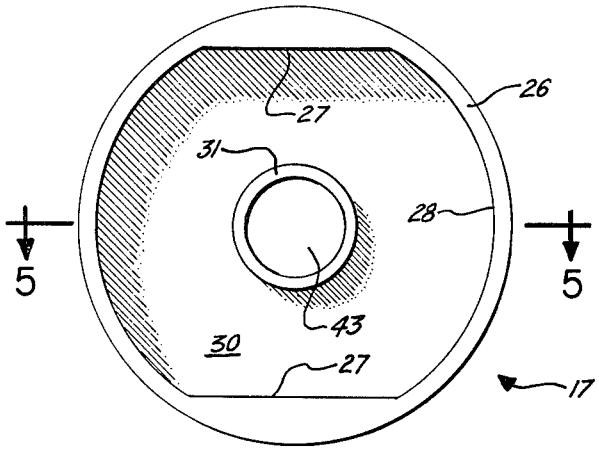
FIG. 4 is a top view of the closure-guide member utilized in the present invention.
Figure 5:
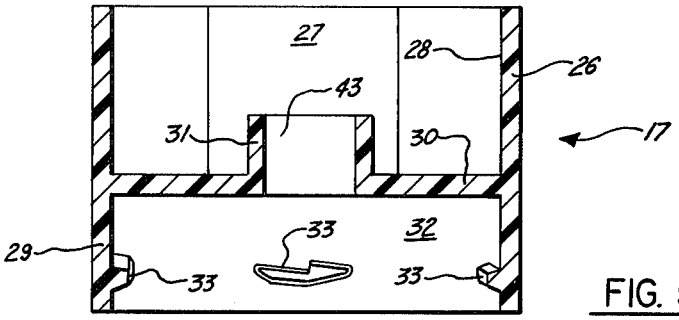
FIG. 5 is a sectional view of FIG. 4 along the lines 5—5.
Figure 6:
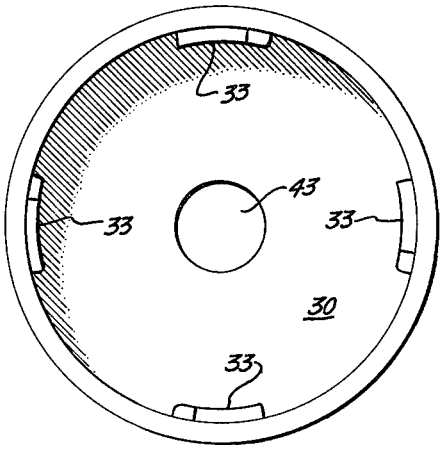
FIG. 6 is a bottom view of FIG. 5.

As indicated the dispenser pump of the present assembly is adapted particularly for use with containers that have hand gripping sections that are readily gripped by the user and may be parallel to or may be offset from the major vertical axis of the container as shown in FIG. 1. Exemplary of containers with offset axes is the container shown in FIGS. 1, 2 and 3 wherein the neck's actual opening is positioned to the left of the center axis of the container. The container 16 is in the form of an oval as can be seen in FIG. 2 and has a lower portion 34 and an upper portion 35 which is equipped with a general cylindrical neck portion 36. The neck portion 36 is provided with four lug type threads. Two of the opposed lug threads 37—37 are short conventional lug threads located about half way up the side wall of the neck portion 36. The other two opposed long threads 38—38 have their terminal ends merging into the shoulder 39 of the neck and are provided with an undercut portion 40 about midway the length of each thread. The undercut portion is located adjacent a downwardly extending vertical stop portion 41. The short and long threads on the container neck are positioned so that when the harpoon-shaped threads 33 on the lower closure section 29 are engaged with the neck thread members it automatically orients the pump dispenser actuator 21 so that the nozzle 22 is aligned parallel to the major transverse axis A—A of the container 16. Two opposed sets of the harpoon-shaped thread members 33—33 are received in the undercut portions of 40—40 of the long threads and the other two opposed harpoon-shaped threads 33—33 have their end portions positioned over the ends of threads 37—37 at their terminal ends. The harpoon-shaped threads are pulled into and maintained in the proper engagement with the long and short neck threads by means of a resilient gasket member 42 that abuts the underside of the flange 19 on the housing, as can be seen more clearly in FIG. 1. The annular gasket 42 may be made of foam thermoplastic materials such as polypropylene, or polyethylene, and is preferably made with solid plastic outer layers on each side of a foamed inner layer to reduce permability of the resilient gasket. By pressing down on the closure-guide member 17 the barbed portion of the harpoon threads 33—33 can be disengaged from the thread members on the neck of the container and the dispenser pump 15 can thus be removed from the container for refilling by the customer.

The finger pump dispenser of this invention provides a child resistant assembly wherein the finger pump is automatically and permanently oriented with the major transverse axis of the container when it is attached thereto so that the nozzle is always oriented away from the user when they pick up the container and actuate the dispenser button. Additionally, the finger pump dispenser of the present invention is child resistant by virtue of the foregoing described thread arrangements used on the neck of the container and the inner wall of the lower closure section of the closure-guide member portion of the pump. While the pump is child resistant it is no problem for an adult to open the spray pump assembly by pressing down on the collar closure member and rotating it counter clockwise to remove the finger pump from the container. The container can then be refilled with the product and the finger spray pump can be attached thereto thus achieving considerable economies by long term use of the container-finger pump dispensing device combination.

The invention has been described in a preferred embodiment but should not be limited to that described and illustrated, it being understood that modifications may be made thereto which are within the ability of those skilled in the art and that the invention described herein should be limited only by the scope of the claims contained herein.

What is claimed is:

1. An assembly for dispensing fluids comprising:

(a) a generally elliptical container having a neck portion with at least two opposed thread members having undercut portions adjacent their terminal ends;

(b) a reciprocating pump including a pump housing having an annular flange at its upper end received in said container;

(c) a stem extending out of the upper end of said pump housing;

(d) a dispensing actuator member received on the upper end of said stem and having a spray nozzle projecting from the side thereof;

(e) a closure-guide member having a transverse wall portion which abuts said flange and a central opening receiving said stem, and a lower skirt portion provided with at least two thread members having harpoon-shaped portions at their leading ends on its inner wall which are received in said undercut portions of said container thread members, and an integrally formed upper guide collar portion which extends over the lower portion of said dispensing actuator member when said actuator member is in the uppermost position;

(f) said dispensing actuator member and said upper guide collar portion having opposed slidable, guiding surfaces that prevents rotation of said dispensing actuator member in said upper guide collar portion throughout the full reciprocating limits of said actuator member;

(g) said container thread members being so positioned on said neck and said closure guide member thread members being so positioned on said lower skirt portion that when they are interlocked said spray nozzle cannot be rotated and is oriented parallel with respect to the major axis of said elliptical container.

2. In the assembly for dispensing fluids of the claim 1, wherein said opposed slidable, guiding surfaces that prevents rotation of said dispensing actuator includes at least one flat surface provided on the outer surface of the sidewall provided on said dispensing actuator and at least one opposed flat surface provided on the inner wall of said upper guide collar, said dispensing actuator flat surface being in position to make slidable contact with said guide collar flat surface throughout the full length of reciprocating movement of said dispensing actuator.

* * * * *